US011168849B2

(12) United States Patent
Weizel

(10) Patent No.: US 11,168,849 B2
(45) Date of Patent: Nov. 9, 2021

(54) SEGMENTALLY EXTENDABLE MODULAR HANDHELD FLASHLIGHT AND RESPECTIVE KIT-OF-PARTS FOR ASSEMBLING THE SAME

(71) Applicant: Daniel Nissan Weizel, Rishon la Zion (IL)

(72) Inventor: Daniel Nissan Weizel, Rishon la Zion (IL)

( * ) Notice: Subject to any disclaimer, the term of this patent is extended or adjusted under 35 U.S.C. 154(b) by 0 days.

(21) Appl. No.: 17/265,542

(22) PCT Filed: Aug. 5, 2019

(86) PCT No.: PCT/IB2019/056637
§ 371 (c)(1),
(2) Date: Feb. 3, 2021

(87) PCT Pub. No.: WO2020/031055
PCT Pub. Date: Feb. 13, 2020

(65) Prior Publication Data

US 2021/0262622 A1 Aug. 26, 2021

(30) Foreign Application Priority Data

Aug. 6, 2018 (GB) ..... 1812719

(51) Int. Cl.
*F21L 4/08* (2006.01)
*F21V 17/00* (2006.01)
*F21Y 115/10* (2016.01)

(52) U.S. Cl.
CPC ..... *F21L 4/085* (2013.01); *F21V 17/002* (2013.01); *F21Y 2115/10* (2016.08)

(58) Field of Classification Search
CPC ..... F21L 4/085; F21L 4/08; F21L 4/02; F21L 4/027; F21L 4/04; F21L 4/005; F21L 4/022; F21L 4/025; F21L 4/045; F21L 4/06; F21V 17/002; F21V 23/0414; F21V 29/00; F21V 19/02; F21Y 2115/10
See application file for complete search history.

(56) References Cited

U.S. PATENT DOCUMENTS

| | | | | |
|---|---|---|---|---|
| 4,151,583 | A | 4/1979 | Miller | |
| 5,197,796 | A | 3/1993 | Moore | |
| 5,791,763 | A | 8/1998 | Kam-Hoi | |
| 5,975,712 | A | 11/1999 | Shiao | |
| 6,046,572 | A | 4/2000 | Matthews et al. | |
| 6,535,917 | B1 * | 3/2003 | Zamanzadeh | G06F 21/34 707/999.009 |
| 6,652,116 | B2 | 11/2003 | Dickinson | |
| 7,594,735 | B2 | 9/2009 | Shahid | |
| 7,631,984 | B2 | 12/2009 | Martin et al. | |
| 8,376,574 | B2 | 2/2013 | Spartano et al. | |
| 8,947,005 | B2 | 2/2015 | Noble et al. | |
| 9,671,098 | B2 * | 6/2017 | Maglica | F21V 23/0414 |

(Continued)

FOREIGN PATENT DOCUMENTS

CN 201696877 1/2011

*Primary Examiner* — Bao Q Truong
(74) *Attorney, Agent, or Firm* — Mark David Torche; Patwrite Law

(57) ABSTRACT

A segmentally extendable modular handheld flashlight and a respective kit-of-parts for assembling the same are described, in which at least one battery segment configurable as an electric charger, in a dismantled conformation.

12 Claims, 5 Drawing Sheets

(56) References Cited

U.S. PATENT DOCUMENTS

| | | | | |
|---|---|---|---|---|
| 2005/0122715 | A1 | 6/2005 | Furth et al. | |
| 2007/0171082 | A1* | 7/2007 | Melnik | F21L 4/005 340/574 |
| 2007/0291479 | A1 | 12/2007 | Martin et al. | |
| 2010/0177508 | A1 | 7/2010 | Maglica | |
| 2013/0128563 | A1 | 5/2013 | Messinger et al. | |
| 2016/0377243 | A1* | 12/2016 | Mercer | F21V 21/005 362/183 |
| 2018/0106437 | A1 | 4/2018 | Maglica et al. | |

* cited by examiner

SEGMENTALLY EXTENDABLE MODULAR HANDHELD FLASHLIGHT AND RESPECTIVE KIT-OF-PARTS FOR ASSEMBLING THE SAME

TECHNICAL FIELD

In general, the present invention pertains to the art of illumination. In particular, the invention relates to a segmentally extendable modular handheld flashlight and a respective kit-of-parts for assembling the same, with at least one battery segment configurable as an electric charger, in a dismantled conformation.

BACKGROUND ART

It is believed that the state of the art is represented by the following patent literature: U.S. Pat. Nos. 4,151,583, 5,197,796, 5,791,763, 5,975,712, 6,046,572, 6,652,116, 7,631,984, 8,376,574 as well as by Chinese utility model 201696877U.

Different situations create scenarios where a variety of flashlight alternatives are necessary. For example, outdoor use may require a bright flashlight with a long burn time. Under such a scenario, flashlight size may not be important, which is preferable, as brighter flashlights with longer burn times tend to be larger in size. Nevertheless, there are other scenarios where ease of carry through the use of a smaller less bright flashlight is most important. Consequently, there are a wide variety of flashlights available, each designed to satisfy a different scenario. Unfortunately, this necessitates the purchase as well as the transport of many different flashlights. Accordingly, a flashlight that is bright, provides suitable burn time, and is modular to satisfy different scenarios is known in the art, for instance from the aforementioned patent literature.

SUMMARY OF THE INVENTION

The following summary of the invention is provided in order to provide a basic understanding of some aspects and features of the invention. This summary is not an extensive overview of the invention and as such it is not intended to particularly identify key or critical elements of the invention or to delineate the scope of the invention. Its sole purpose is to present some concepts of the invention in a simplified form as a prelude to the more detailed description that is presented below.

The invention was made in view of the deficiencies of the prior art and provides systems, methods and processes for overcoming these deficiencies. According to some embodiments and aspects of the present invention, there is provided, a modular flashlight that includes a flashlight head assembly configured to operate with either one battery or two batteries. In the one battery configuration, the flashlight head assembly is connected with a body adapted to receive a battery therein. Activation of a switch assembly delivers power from the battery to the flashlight head assembly. In the two battery configuration, an extension unit adapted to receive a battery therein connects to the body and the flashlight head assembly connects to the extension unit.

The flashlight head assembly includes an LED driver circuit that drives an LED of the flashlight head assembly. The LED driver circuit includes a voltage buck/boost that provides regulated voltage from the one battery or two batteries to an LED driver. The LED driver circuit further includes a voltage reference circuit that monitors incoming voltage to the buck/boost incoming voltage to a preset value.

The LED driver circuit still further includes a current monitor/regulator that maintains a constant current in the LED independent of the voltage applied to the buck/boost.

Technical Problem

Flashlights known in the art, for instance from the aforementioned patent literature, all employ replaceable electric batteries, whether researchable or non-researchable. When researchable electric batteries are used, consequent or extended usage of the flashlight is non-advantageously requires currying along replaceable electric batteries and/or electric charger for researchable electric batteries of the segmentally extendable modular handheld flashlight.

Solution to Problem

According to some embodiments and aspects of the present invention, there is provided, a modular flashlight assemblable from a kit-of-parts, includes at least one battery segment configurable as an electric charger, in a dismantled conformation. The at least one battery includes a driver circuit, configured to increase and/or decrease the input and/or output voltage for researchable electric batteries of the segmentally extendable modular handheld flashlight.

Advantageous Effects of Invention

The at least one battery segment, configurable as an electric charger, in a dismantled conformation, preferably provides for charging researchable electric batteries, by being electrically coupled to an external power source; thereby obviating the need of carrying along an electric charger for researchable electric batteries of the segmentally extendable modular handheld flashlight.

The at least one battery segment, configurable as an electric charger, in a dismantled conformation, preferably provides for charging electronic devices, by being electrically coupled to the at least one battery segment, when configured as charger; thereby provide for an expedient and convenient.

DEFINITIONS

The acronym LED, as referred to herein, is to be construed as any light source component, which includes one or more light emitting diodes, used as lighting modules that include one or more such light source components, as well as to lighting systems which include a plurality of such lighting modules. The term light emitting diode or electroluminescent diode refers to any type of carrier injection/junction-based system that is capable of generating radiation in response to an electric signal. Thus, the acronym LED includes, but is not limited to, various semiconductor-based structures that emit light in response to current, light emitting polymers, organic light emitting diodes (OLEDs), electroluminescent strips, and the like. In particular, the term LED refers to light emitting diodes of all types (including semi-conductor and organic light emitting diodes) that may be configured to generate radiation in one or more of the infrared spectrum, ultraviolet spectrum, and various portions of the visible spectrum (generally including radiation wavelengths from approximately 400 nanometers to approximately 700 nanometers). Some examples of LEDs include, but are not limited to, various types of infrared LEDs, ultraviolet LEDs, red LEDs, blue LEDs, green LEDs, yellow LEDs, amber LEDs, orange LEDs, and white LEDs (discussed further below). It also should be appreciated that LEDs may be configured and/or controlled to generate radiation having various bandwidths (e.g., full widths at half maximum, or FWHM) for a given spectrum (e.g., narrow bandwidth, broad bandwidth), and a variety of dominant wavelengths within a given general color categorization.

The term electric battery, as referred to herein, is to be construed as any device that produces and/or stores electrical energy as a result of a chemical reaction, and may refer to any of a variety of different cell chemistries and configurations including, but not limited to, lithium ion (e.g., lithium iron phosphate, lithium cobalt oxide, other lithium metal oxides, etc.), lithium ion polymer, nickel metal hydride, nickel cadmium, nickel hydrogen, nickel zinc, silver zinc, or other battery type/configuration. As used herein the term battery and/or term electric battery refers to component that supplies or supply electric energy to a LED assembly. The term battery includes rechargeable batteries and encompasses electrical interconnection of one or more rechargeable cells inside a battery housing.

Whenever in the specification hereunder and particularly in the claims appended hereto a verb, whether in base form or any tense, a gerund or present participle or a past participle are used, such terms as well as preferably other terms are to be construed as actual or constructive, meaning inter alia as being merely optionally or potentially performed and/or being only performed anytime in future.

In addition, as used herein, the term "or" is an inclusive "or" operator, equivalent to the term "and/or," unless the context clearly dictates otherwise; whereas the term "and" as used herein is also the alternative operator equivalent to the term "and/or," unless the context clearly dictates otherwise.

It should be understood, however, that neither the briefly synopsized summary nor particular definitions hereinabove are not to limit interpretation of the invention to the specific forms and examples but rather on the contrary are to cover all modifications, equivalents and alternatives falling within the scope of the invention.

DESCRIPTION OF THE DRAWINGS

The present invention will be understood and appreciated more comprehensively from the following detailed description taken in conjunction with the appended drawings in which.

Figure 1:
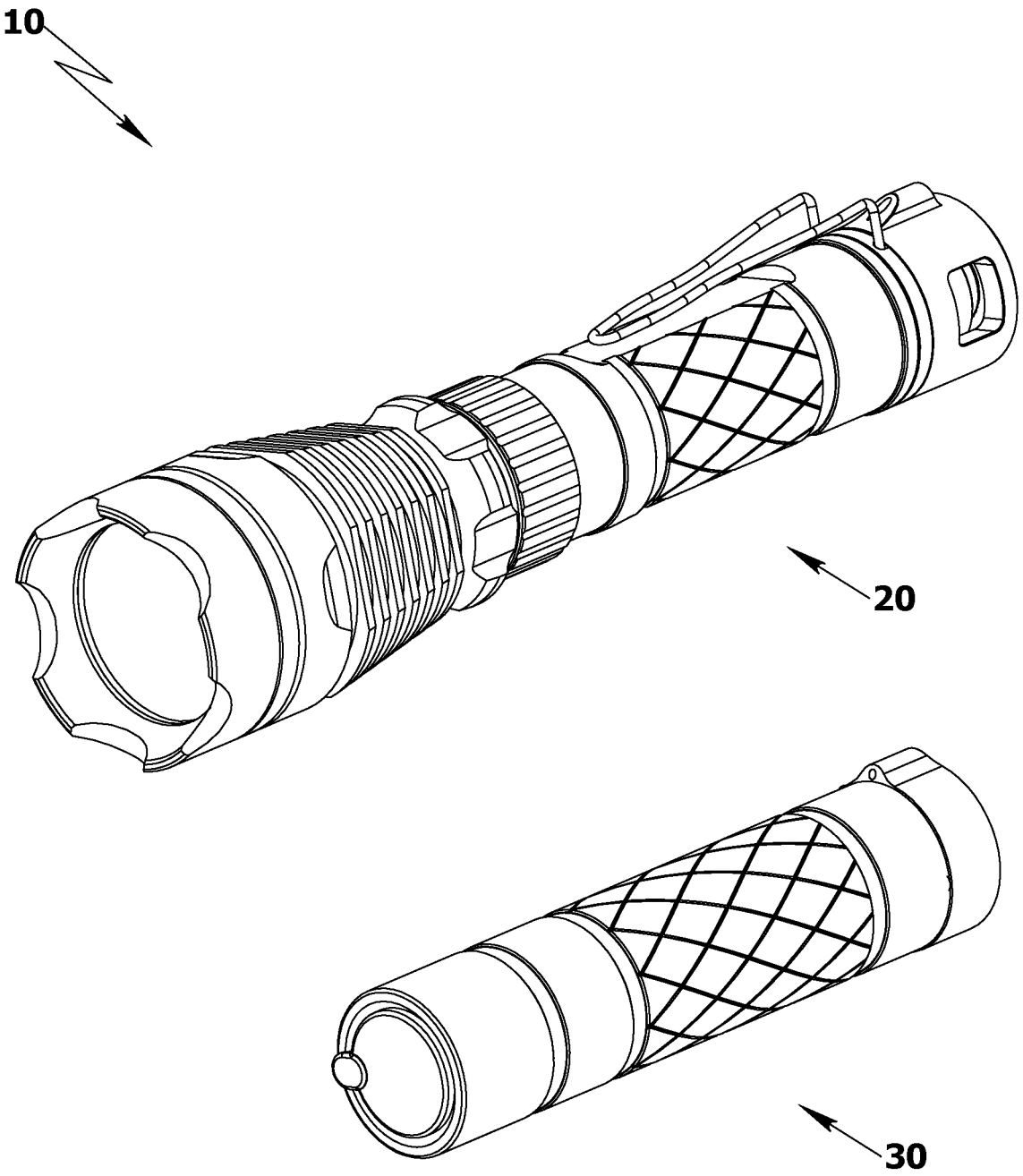
FIG. 1 is an isometric view of a modular assemblable flashlight in a single battery configuration and additional segment configured as an electric charger, in accordance with some preferred embodiment of the present invention.

While the invention is susceptible to various modifications and alternative forms, specific embodiments thereof have been shown merely by way of example in the drawings. The drawings are not necessarily complete and components are not essentially to scale; emphasis instead being placed upon clearly illustrating the principles underlying the present invention.

DETAILED DISCLOSURE OF EMBODIMENTS

Illustrative embodiments of the invention are described below. In the interest of clarity, not all features of actual implementation are described in this specification. It will of course be appreciated that in the development of any such actual embodiment, numerous implementation-specific decisions must be made to achieve the developers' specific goals, such as compliance with technology- or business-related constraints, which may vary from one implementation to another. Moreover, it will be appreciated that the effort of such a development might be complex and time-consuming but would nevertheless be a routine undertaking for those of ordinary skill in the art having the benefit of this disclosure.

Figure 2:
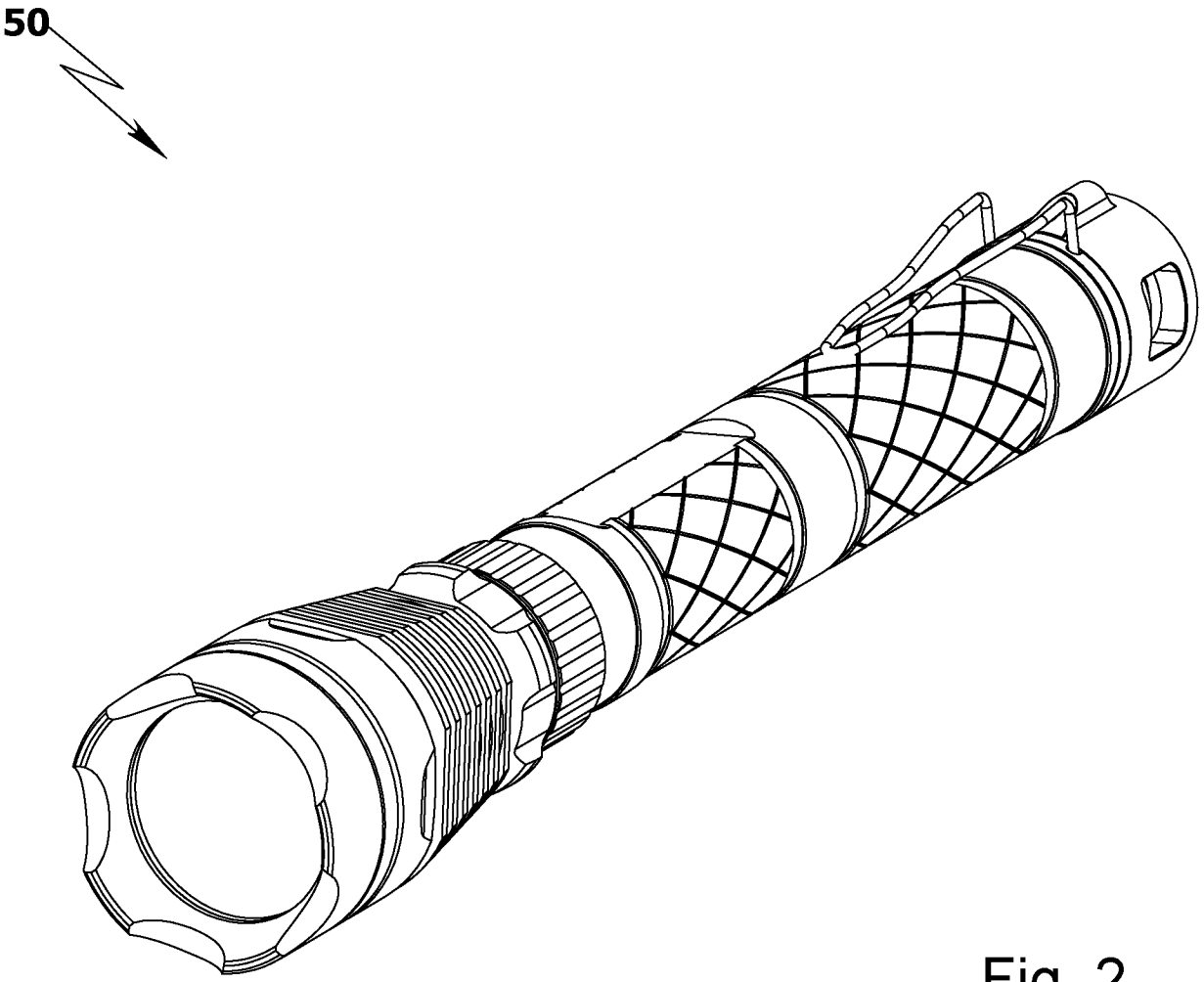
FIG. 2 is an isometric view of the modular assemblable flashlight in a double battery configuration, where the additional segment is segmentally assembled in tandem, in accordance with some preferred embodiment of the present invention.

In accordance with some embodiments of the present invention, reference is now made to FIG. 1, showing kit-of-parts 10 for assembling a modular flashlight, including modular assemblable flashlight 20 in a single battery configuration and additional segment 30, configured as an electric charger, as well as to FIG. 2, showing modular assemblable flashlight 50, in a double battery configuration.

Figure 3:
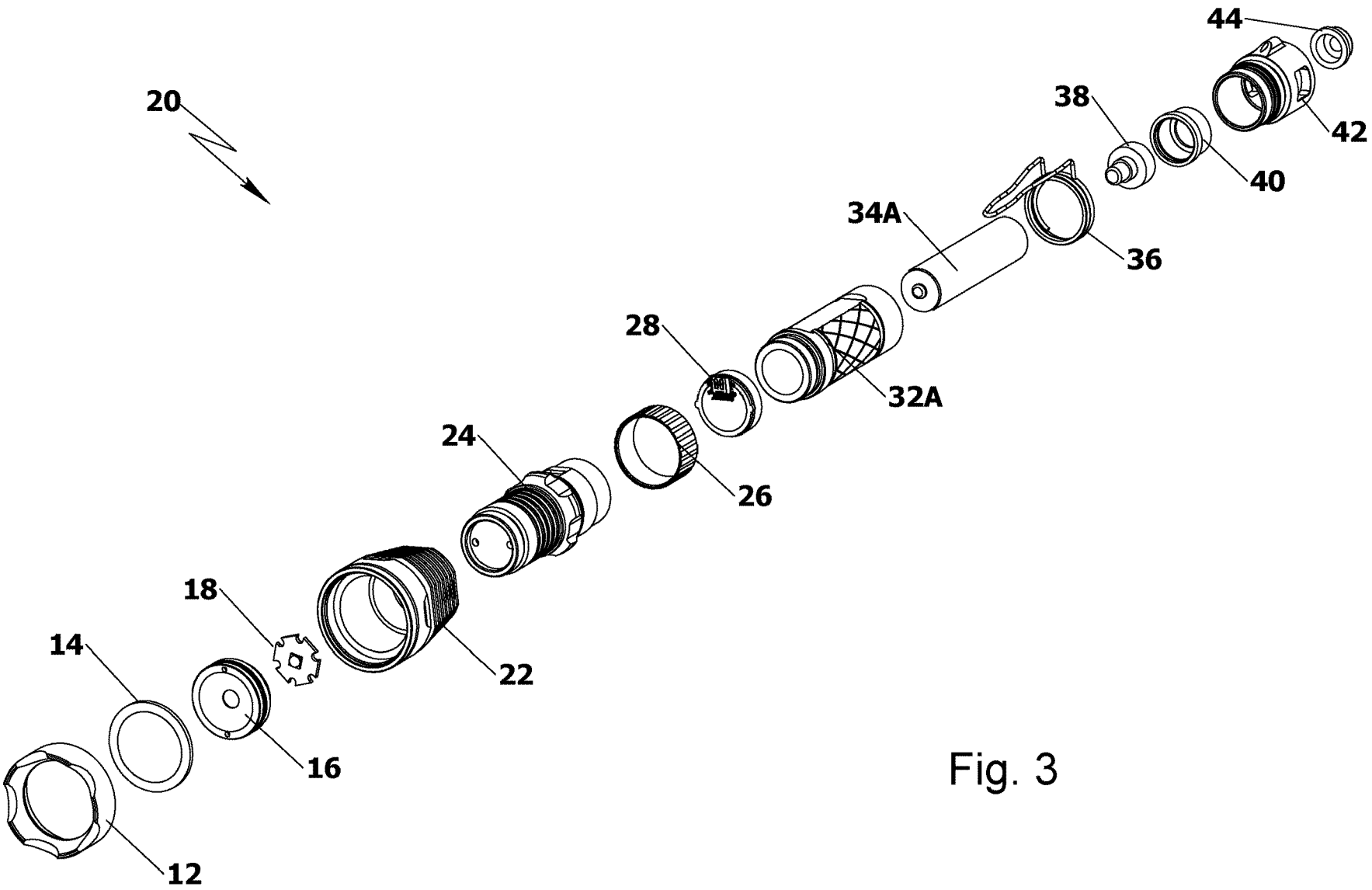
FIG. 3 is an exploded isometric view of the modular assemblable flashlight in a single battery configuration, shown in FIG. 1.
Figure 4:
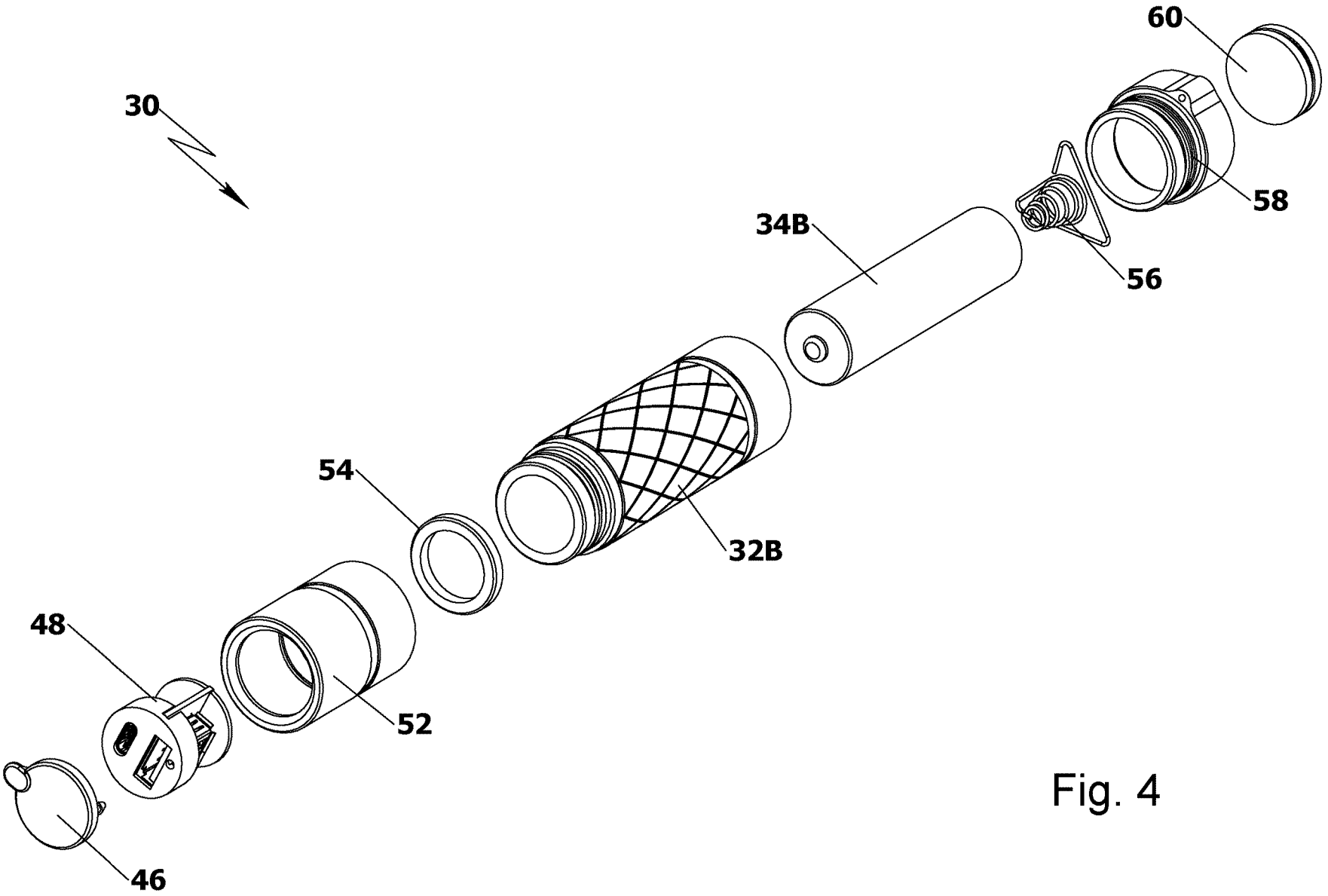
FIG. 4 is an exploded isometric view of the additional segment configured as an electric charger, shown in FIG. 1.

Reference is now further made to FIG. 3, showing the constituents of assemblable flashlight 20, in a single battery configuration, as well as to FIG. 4, showing the constituents of additional segment 30, configured as an electric charger. Modular assemblable flashlight 20 in a single battery configuration, as shown in FIG. 3, comprises hood 12, watertight gasket 14, reflector 16, LED mounted on PCB plate 18, flashlight's head housing 22, driver circuit part 24, configured to increase and/or decrease the input and/or output voltage, closure ring 26, charging port member 28, battery housing 32A, battery 34A, annual clip 36, posterior battery current collector 38, posterior watertight gasket 40, flashlight's posterior part 42 including an on/off switching knob and on/off knob cover 44.

Additional segment 30, configured as an electric charger, as shown in FIG. 4, comprises watertight closure 46, charring ports 48 part preferably comprising a driver circuit part configured to increase and/or decrease the input and/or output voltage, charring port housing part 52, watertight gasket 54, battery housing 32B, battery 34B, posterior charger current collector 56, charger's posterior part 58 and posterior watertight closure 60 preferably comprising an embedded compass (not shown).

Modular assemblable flashlight 20 in a single battery configuration, shown in FIGS. 1 and 3, includes single battery 34A and driver circuit part 24 preferably increases the output voltage, thereby providing for a more compact construction and relatively shorter working life time. Whilst modular assemblable flashlight 20 is in a single battery configuration, shown in FIGS. 1 and 3, additional segment 30 is configurable as an electric charger, as shown in FIGS. 1 and 4. Whilst additional segment 30, shown in FIGS. 1 and 4, is configured as an electric charger, charring port/s part 48, a driver circuit of part 48 optionally increases or decreases respectively the input or output voltage, thereby rendering the ports available for charging battery 34B inside additional segment 30 from an external power source or use the electric charge in battery 34B for powering an external electrical power consuming device, such as a smartphone.

In a double battery configuration, shown in FIG. 2, modular assemblable flashlight 50 comprises first battery housing 32A with battery 34A assembled in tandem to second battery housing 32A with battery 34A, thereby providing for a more elongated construction. In a double battery configuration, shown in FIG. 2, driver circuit part 24 of modular assemblable flashlight 50 typically decreases the output voltage, thereby providing for a relatively prolonged working time.

BEST MODE FOR PRACTICING AND CARRYING OUT THE INVENTION

Figure 5:
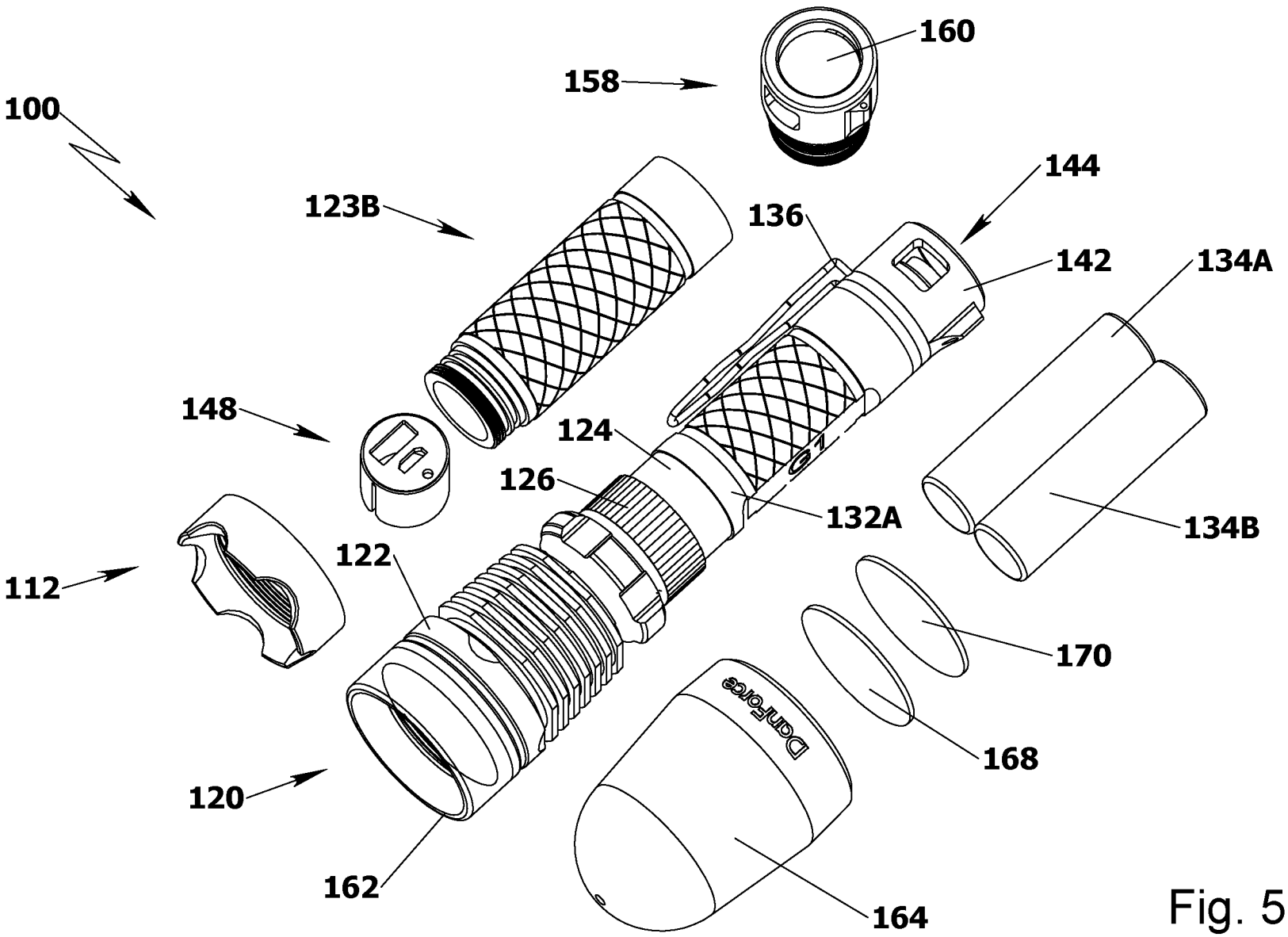
FIG. 5 is an isometric view of an entire kit-of-parts a modular assemblable flashlight in a single battery configuration and additional segment configured as an electric charger, in accordance with another preferred embodiment of the present invention.

In accordance with another preferred embodiment of the present invention, reference is now made to FIG. 5, showing kit-of-parts 100 configured for assembling the modular segmentally extendable flashlight. Kit-of-parts 100 of the embodiment shown in FIG. 5 includes various features and/or elements that are interchangeable with features and/or elements of any other embodiment described in this specification. Kit-of-parts 100 includes assembly of flashlight 120 in a single battery configuration as well as several optional parts.

Flashlight 120 in a single battery configuration, as shown in FIG. 5, comprises hood 112, flashlight's head housing 122, driver circuit part 124 typically including a driver circuit configured to increase and/or decrease the input and/or output voltage as well as a charging port (not shown) configured to supply and/or consume input/output electricity, closure ring 126 configured to cover the charging port (not shown), battery housings 32A and 32B, batteries 34A and 34A, annual clip 136, flashlight's posterior part 142 including an on/off switching knob and on/off knob cover 144.

Kit-of-parts 100 further comprises charring port/s 148 part preferably comprising a driver circuit part configured to increase and/or decrease the input and/or output voltage, charring port housing part (not shown), battery housing 132B, battery 134B, chargers posterior part 158 and posterior watertight closure 160 preferably comprising an embedded compass (not shown).

Kit-of-parts 100 optimally further comprises alternative hood 162, top cover 164, red filter 168 and blue filter 170. It should be acknowledged that alternative hood 162, top cover 164, red filter 168 and blue filter 170 are merely optional and non-limiting constituents of kit-of-parts 100.

It will be appreciated by persons skilled in the art that the present invention is not limited by what has been particularly shown and described herein above. Rather the scope of the invention is defined by the claims which follow:

The invention claimed is:

1. A modular segmentally extendable flashlight comprises:

(a) a flashlight head housing comprising:
  (I) a hood;
  (II) a reflector;
  (III) a light emitting diode mounted on printed circuit board plate;

(b) a flashlight body portion comprising:
  (I) a first battery housing;
  (II) a second battery housing;
  (III) a charging port member;
  (IV) a driver circuit configured to perform at least one operation selected from the group consisting of: increasing input voltage, decreasing input voltage, increasing output voltage and decreasing output voltage;

(c) a flashlight posterior part comprising:
  (I) a posterior battery current collector;
  (II) an on/off switching knob, and
  (III) a knob cover, configured for hermetically sealing said knob;

wherein said modular segmentally extendable flashlight embodies at least one configuration selected from the group consisting of: a double battery configuration, wherein said first battery housing and said second battery housing are assembled in tandem in-between said flashlight head housing and said flashlight posterior part, and a single battery configuration, wherein said first battery housing is assembled in-between said flashlight head housing and said flashlight posterior part, whereas said second battery housing is configurable as an individual standalone electric power bank charger.

2. The modular segmentally extendable flashlight, as in claim 1, wherein said charging port member comprises a charging port and wherein said driver circuit renders said charging port configured for charging at least one member selected from the group consisting of:

(a) at least one battery inside at least battery housing selected from the group consisting of: said first battery housing and said second battery housing from an external power source, and (b) external electronic device from said charging port.

3. The modular segmentally extendable flashlight, as in claim 1, wherein said flashlight posterior part further comprises an embedded compass.

4. The modular segmentally extendable flashlight, as in claim 1, wherein in said double battery configuration, said driver circuit decreases said output voltage, thereby providing for a prolonged working time.

5. A kit-of-parts for assembling a modular segmentally extendable flashlight, comprises:

(a) a hood;
(b) a reflector;
(c) a light emitting diode mounted on printed circuit board plate;
(d) a first battery housing;
(e) a second battery housing;
(f) a charging port member;
(g) a driver circuit configured to perform at least one operation selected from the group consisting of: increasing input voltage, decreasing input voltage, increasing output voltage and decreasing output voltage;
(h) a posterior battery current collector;
(i) an on/off switching knob, and
(j) a knob cover, configured for hermetically sealing said knob;

wherein said modular segmentally extendable flashlight embodies at least one configuration selected from the group consisting of: a double battery configuration, wherein said first battery housing and said second battery housing are assembled in tandem in-between said flashlight head housing and said flashlight posterior part, and a single battery configuration, wherein said first battery housing is assembled in-between said flashlight head housing and said flashlight posterior part, whereas said second battery housing is configurable as an individual standalone electric power bank charger.

6. The kit-of-parts, as in claim 5, wherein said charging port member comprises a charging port configured for charging at least one member selected from the group consisting of:

(a) at least one battery inside at least battery housing selected from the group consisting of: said first battery housing and said second battery housing from an external power source, and (b) external electronic device from said charging port.

7. The kit-of-parts, as in claim 5, wherein said flashlight further comprises an embedded compass at a posterior part thereof.

8. The kit-of-parts, as in claim 5, wherein in said double battery configuration, said driver circuit decreases said output voltage, thereby providing for a prolonged working time.

9. A method of assembling a modular segmentally extendable flashlight, comprises:

(a) providing a kit-of-parts comprising:

(I) a hood;

(II) a reflector;

(III) a light emitting diode mounted on printed circuit board plate;

(IV) a first battery housing;

(V) a second battery housing;

(VI) a charging port member;

(VII) a driver circuit configured to perform at least one operation selected from the group consisting of: increasing input voltage, decreasing input voltage, increasing output voltage and decreasing output voltage;

(VIII) a posterior battery current collector;

(IX) an on/off switching knob, and (b) assembling said modular segmentally extendable flashlight in a double battery configuration, wherein said first battery housing and said second battery housing are assembled in tandem, and (c) assembling said modular segmentally extendable flashlight in a single battery configuration, wherein said first battery housing is assembled as a part of said modular segmentally extendable flashlight, whereas said second battery housing is configurable as an individual standalone electric power bank charger.

10. The method, as in claim 9, wherein said charging port member comprises a charging port, further comprises at least one member selected from the group consisting of:

(a) charging at least one battery inside at least battery housing selected from the group consisting of: said first battery housing and said second battery housing from an external power source, and (b) charging external electronic device from said charging port.

11. The method, as in claim 9, wherein said flashlight further comprises an embedded compass at a posterior part thereof.

12. The method, as in claim 9, further comprises decreasing said output voltage, in said double battery configuration, thereby providing for a prolonged working time.

* * * * *